United States Patent [19]

Lemperiere

[11] Patent Number: 5,061,118

[45] Date of Patent: Oct. 29, 1991

[54] OVERFLOW SPILLWAY FOR DAMS, WEIRS AND SIMILAR STRUCTURES

[75] Inventor: Francois Lemperiere, Meudon, France

[73] Assignee: GTM Batiment et Travaux Publics, Nanterre Cedex, France

[21] Appl. No.: 629,822

[22] Filed: Dec. 19, 1990

[30] Foreign Application Priority Data

Dec. 28, 1989 [FR] France ..... 89 17333

[51] Int. Cl.[5] ..... E02B 7/22; E02B 8/06

[52] U.S. Cl. ..... 405/108; 405/94; 405/114

[58] Field of Search ..... 405/80, 87, 90, 91, 405/94, 107, 108, 114, 115

[56] References Cited

U.S. PATENT DOCUMENTS

| | | | |
|---|---|---|---|
| 972,059 | 10/1910 | Clarke | 405/114 |
| 1,266,748 | 5/1918 | Zimmerman | 405/108 |
| 1,806,255 | 5/1931 | Groner et al. | 405/114 |
| 1,938,675 | 12/1933 | Young | 405/94 |
| 2,118,535 | 5/1938 | Betts | 405/94 |
| 4,787,774 | 11/1988 | Grove | 405/94 |

*Primary Examiner*—David H. Corbin

*Attorney, Agent, or Firm*—Amster, Rothstein & Ebenstein

[57] ABSTRACT

For the purpose of effecting a quasi-permanent raising of the normal water level of an impounded reservoir and thereby augmenting its storage capacity except during the passage of major floods, the invention consists of rigidly fixing to the sill of the spillway a water level raising means comprising at least one vertical plate capable of resisting the water loads when spilling moderate heads (for discharging the floods of shorter recurrence intervals) but bending at its lower portion where it is fixed to the sill at a predetermined head not higher than the maximum water level in order to discharge larger floods.

13 Claims, 5 Drawing Sheets

N
29
24a
24
29a

N
24
28

24a
27
24
26a
26
27
N

N
10
22
11
25
6
24a
24
21
23
RN'

6
RN 6
10
11
17
RN'

RM
6
17
10
11
RN

OVERFLOW SPILLWAY FOR DAMS, WEIRS AND SIMILAR STRUCTURES

TECHNICAL FIELD

This invention concerns an overflow spillway for dams and similar structures comprising an overspill sill whose crest is set at a first predetermined level, lower than a second predetermined level corresponding to the maximum reservoir level for which the dam is designed, the difference between the said first and second predetermined levels corresponding to a predetermined maximum discharge of a design flood and a moveable water level raising means on the sill.

BACKGROUND OF THE INVENTION

Current practice for the design and construction of overspill dams is such that they are designed for flood conditions (e.g. 1000-year flood) producing very high heads on the sill when spilling (depth of water on the sill of the order of 1 m to 5 m).

For a given flood discharge capacity, an uncontrolled overflow spillway offers greater safety against hydrological uncertainty (one of the most important risks for a dam) than gated discharge works.

Against this advantage, a completely uncontrolled overspill is wasteful of live reservoir capacity, by an amount commensurate with the maximum head of water on the sill, i.e. the difference in elevation between the abovementioned two predetermined levels. The capacity thus lost may represent a significant percentage (as much as or even more than 50%) of total live reservoir capacity, especially for dams of small to moderate size.

The problem which the invention is intended to solve can be summarised in the following two principle goals which may be obtained singly or in combination:

1) To augment the storage capacity of a dam with an uncontrolled overflow spillway, on a near-permanent basis.

2) To retain and/or increase the safety and reliability of operation that is an inherent feature of uncontrolled overflow spillways by permitting the unobstructed passage of major floods while tolerating overspilling by small or moderate floods without outside action or any significant modification to the existing structure.

Various means for augmenting reservoir capacity have been proposed and currently exist. Most consist basically of some system of gates which prevent flow over the sill when closed. Automatically or manually operated, conventional or inflatable gates of all kinds generally exhibit high capital cost and demand routine maintenance and periodic testing. They also demand continuous human supervision or an often costly and sophisticated automatic system controlled by the water level in the reservoir which is never totally free from the risk of breakdown or malfunction. Lastly, for a given discharge capacity, the safety and reliability of operation of gated discharge works are less than for an uncontrolled (ungated) overflow spillway.

There are means of temporarily augmenting reservoir storage capacity such as sandbags or flashboards but they are of limited utility and since they demand human action prior to the arrival of every river flood, they involve a major risk.

Some large embankment dams are provided with 'fuse plug' sections topped out at a lower crest elevation than the main dam which operate by erosion of the constituent materials when a very large flood causes a large rise in headwater level. The fuse plug is designed to prevent uncontrolled catastrophic overspilling of a major flood over the main dam by concentrating its effects on a specially prepared section designed to be washed away by erosion to provide extra discharge capacity. Once the fuse plug has been destroyed, major repair works are necessary before the dam can be restored to normal service.

To the applicant's knowledge, there would thus appear to be no means currently in existence of satisfactorily fulfilling the goals stated hereinabove, of simple operation and moderate cost.

SUMMARY OF THE INVENTION

With the invention, the abovementioned problem is solved by the fact that the water level raising means comprises at least one water level raising element in the form of a substantially vertical plate whose lower portion is rigidly fixed to the sill of the spillway, the said element having a predetermined height which is less than the difference between the aforementioned first and second predetermined levels and which corresponds, for a headwater level substantially equal to the said maximum level, to a mean flood with a predetermined lower discharge than the predetermined maximum discharge, the said element being of such thickness at its fixed lower portion and made of a material with such a yield point that the moment of the forces applied to the water level raising element by the water comes to equal the resisting moment at the fixed lower portion of the said element so that the said water level raising element bends about a line when the headwater reaches a third predetermined level higher than the top of the water level raising element but not higher than the second predetermined level.

Under these circumstances, it is clear that the storage capacity of the dam is augmented by an amount commensurate with the height of the water level raising element(s). The element(s) can be fabricated at a more moderate cost than gates and if they are installed on the sill of an existing dam, there is no need for any major modifications thereto as will be described below. It is also clear that, during floods of moderate size, so long as the headwater does not reach the said third predetermined level which in practical terms can be set equal to or slightly lower than the said second predetermined level (i.e. maximum level or maximum reservoir level), water can spill over the element(s) to discharge the flood without destroying the element(s) and thereby, without any reduction in the augmented storage capacity of the dam. During a major flood the headwater reaches the said third predetermined level and the element(s) automatically bend about their fixed lower portions solely by the action of the water loads with no external contribution, thus restoring to the spillway its full discharge capacity as determined by the head on the sill for which the dam was designed.

At its lower portion, the plate forming the water level raising element can be let into a slot in the spillway sill or in some form of mounting device fixed rigidly to the sill. Alternatively the plate forming each water level raising element may be substantially L-shaped, as seen in cross section, and its horizontal leg can be fixed rigidly to the sill by e.g. bolts. The lower portion can be sealed against the ingress of water by filling the slot with an appropriate substance and/or by an appropriate type of seal or waterstop. When the water level raising means consists of two or more plates side-by-side along the spillway crest, seals can also be provided between adjacent edges of contiguous plates.

The invention is applicable to the sills of existing dam spillways as well as those under construction. In the first case, the crest of the existing sill is preferably cut back lower than the said first predetermined level and the water level raising element(s) fixed on the lowered sill. In this case, the storage capacity of the dam can be maintained at the same value as before the lowering of the sill or it can be augmented, depending on whether the height of the water level raising element(s) is such that their tops are level with or higher than the said first predetermined level but lower than the said third predetermined level. Regardless of the height of the water level raising element(s) within the limits described, safety is greater than with the unlowered spillway sill since the free passage obtained after the bending of the said element(s) is deeper when the sill has been lowered so that the spillway can discharge a larger flood than the original design flood.

In designing a new dam, the difference between the first and second predetermined levels can be increased (which increases safety) without reducing storage capacity since capacity can be maintained or augmented without reducing safety by providing one or more water level raising elements all as described herein.

If more than one element are to be provided, an element or group of elements can be designed to bend at a lower predetermined headwater level than another element or group of elements which themselves can be designed to bend at a lower headwater level than a third element or group of elements, and so on. In this way, it is possible, if desired, to increase discharge capacity progressively to suit the size of the river flood.

If one or more elements have been bent by a major flood, they can be conveniently and cheaply replaced with new elements without the need for any major repairs after the flood has receded.

Other features, benefits and advantages will appear in the course of the ensuing description of various embodiments of the invention, given as an illustration only, with reference to the appended drawings in which:

DETAILED DESCRIPTION

Figure 1:
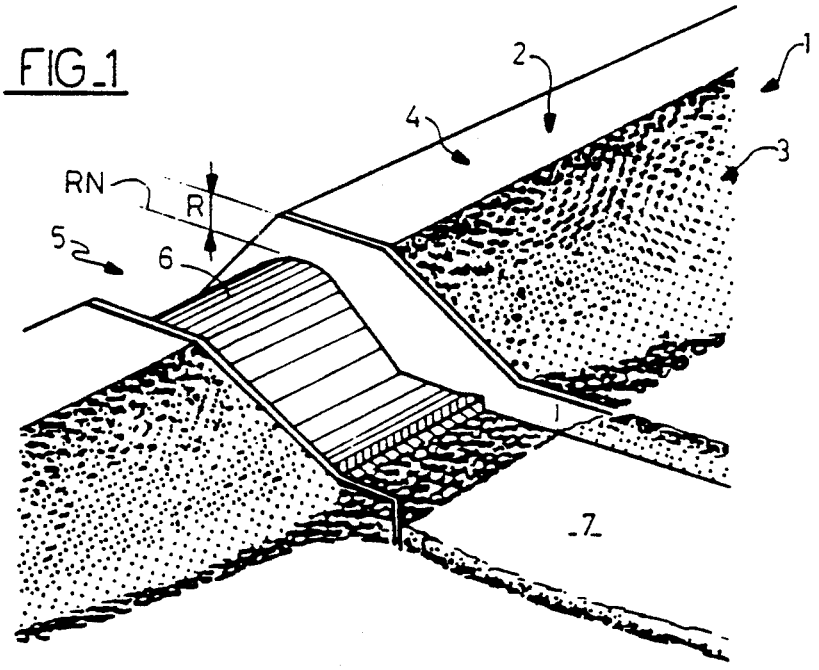
FIG. 1 is a perspective view of a structure such as a dam with an uncontrolled overflow spillway to which the invention can be applied.

The structure 1 shown in FIG. 1 may be an earth or rock dam or a concrete or masonry dam. It is stressed that the invention is not confined to the type of dam shown in FIG. 1 but on the contrary is applicable to any type of known dam with an uncontrolled spillway.

In FIG. 1, reference numeral 2 designates the dam crest, 3 is the downstream dam face, 4 is the upstream dam face, 5 is the spillway, 6 is the sill of spillway 5 and 7 is a discharge channel. The spillway 5 may be located in the central section of dam 1 or at one extremity thereof or excavated in the river bank without affecting the applicability of the invention.

Figure 2A:
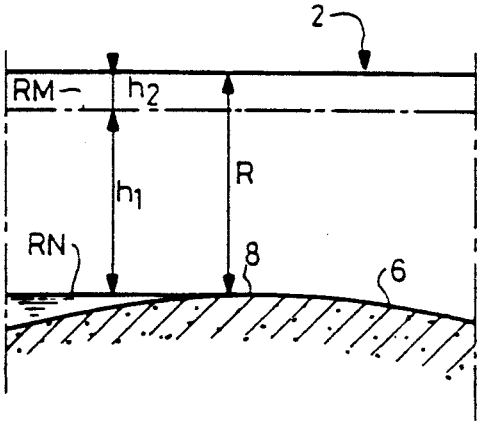
FIGS. 2*a* and 2*b* are vertical sections at larger scale of the crest of the uncontrolled spillway sill of the dam shown in FIG. 1 for two different headwater levels.
Figure 2B:
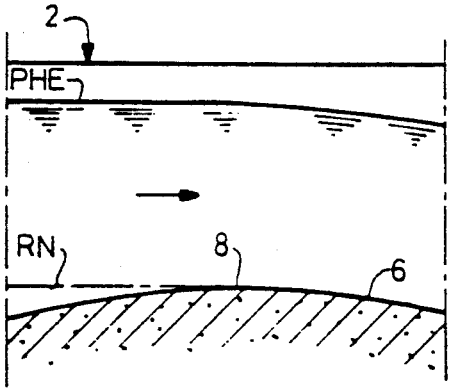

At a dam with an uncontrolled overflow spillway, the level RN called the full supply level when the dam is operating (see also FIG. 2*a*) is determined by the crest 8 of sill 6. The elevation of level RN determines the maximum reservoir storage capacity which is the maximum volume of water that can be impounded by the dam. The vertical distance R, called the freeboard, between the spillway crest 8 and the crest 2 of the dam is the sum of two terms, viz. a rise $H_1$ in the headwater level due to the arrival of a river flood up to the highest flood level RM or maximum water level PHE when the spillway is discharging the maximum flow for which it is designed (FIG. 2*b*), and the additional height $H_2$ protecting the dam crest 2 against oscillations of the water surface at RM (waves, seiches, etc.).

In a conventional dam with uncontrolled overflow spillway like the structure shown in FIG. 1, the volume of water between full supply level RN and maximum water level RM is not stored and is therefore wasted. One of the purposes of the invention is to heighten on a near-permanent basis the full supply level of the reservoir and thereby augment the reservoir storage capacity except when major floods have to be discharged.

Figure 3:
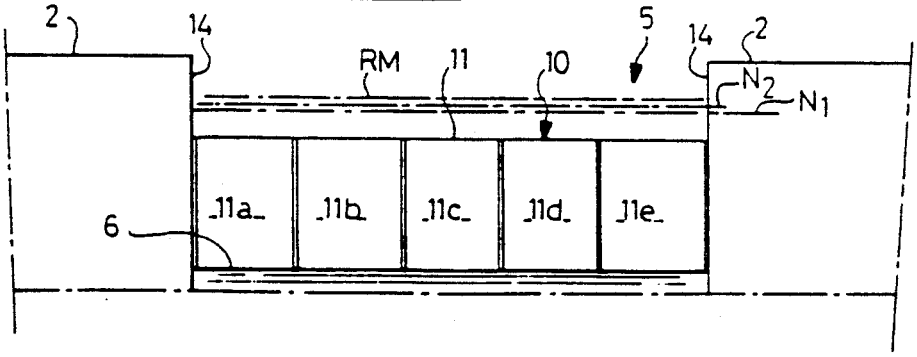
FIG. 3 is a view in elevation of the spillway shown in FIG. 1 seen from the downstream side and provided with water level raising means of the invention.
Figure 4:
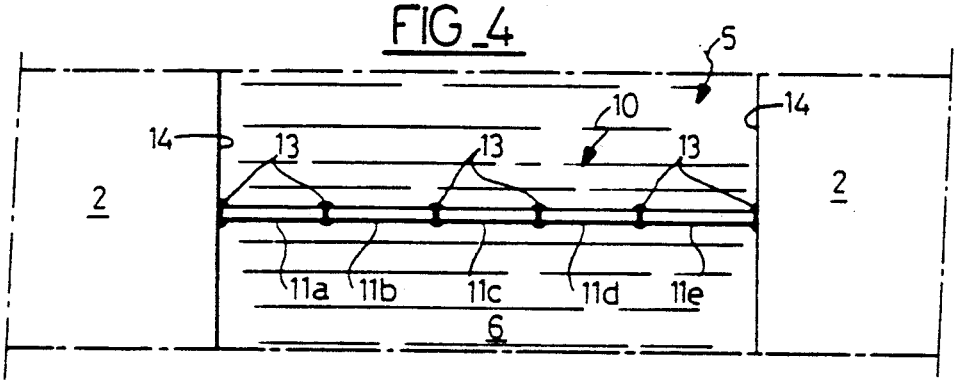
FIG. 4 is a plan view of the spillway shown in FIG. 3.

For this purpose, the invention involves rigidly fixing onto or into the overspill sill 6 a water level raising means 10 comprising at least one element 11, in the form of a plate, for example five elements 11*a*–11*e* as illustrated in FIGS. 3 and 4, the water level raising means 10 and elements 11 thereof being capable of resisting without failure the head of water caused by moderate spilling (to discharge the more frequent floods) but being capable of bending about a bending line at the boundary between their fixed lower portions and free upper portions under a predetermined head corresponding to a level N not higher than the maximum level RM and allowing the largest floods to discharge.

The number of elements 11 in the water level raising means is not limited to five as shown in FIGS. 3 and 4 but may be more or less to suit the length (reckoned lengthwise along the dam) of the spillway 5. The number of elements is preferably chosen such as to have small unit weights for ease of installation and replacement of the said elements.

Figure 5:
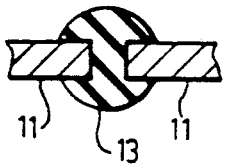
FIG. 5 is a larger scale view of a horizontal section through a seal which can be used between adjacent elements of the water level raising means shown in FIGS. 3 and 4.

As illustrated in FIG. 4, a conventional seal 13 made of rubber for example is provided at each end of the water level raising means 10 between the said means and the training walls 14 of the spillway 5. When the water level raising means 10 is made up of more than one element 11, seals 13 (FIG. 5) are also provided between the vertical edges of adjacent elements 11 as illustrated in FIG. 4. All seals 13 must be such as not to obstruct the bending of the water level raising elements 11 with respect to each other or the training walls 14 of spillway 5 when necessary to discharge a major flood.

Figure 6:
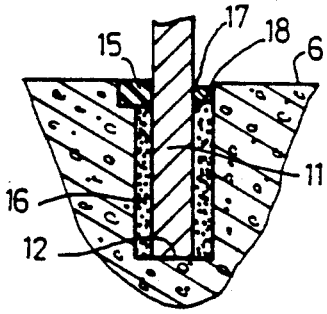
FIGS. 6 and 7 are larger scale cross sections of two variants for letting the water level raising elements into the sill.
Figure 7:
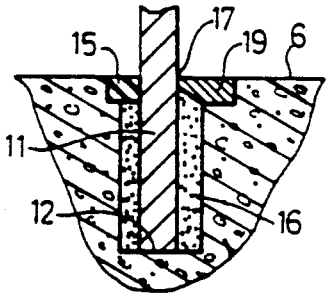

Each water level raising element 11 consists of a plate made of metal (suitably protected against corrosion) or other material capable of bending. At its lower edge, the plate 11 may be let into a restraining slot 12 in the sill 6 of spillway 5, the said slot 12 being slightly wider than the thickness of the plate 11 as shown in FIGS. 6 and 7. Leakage at the lower edges of the plate can be controlled by a seal 15 between the sill 6 and the lower part of the plates 11, e.g. on the upstream sides of the plates and/or by an infilling substance 16 such as sand for example, placed in the slot on either side of the plate 11.

As shown in FIGS. 6 and 7, the line 17 about which the elements 11 are designed to bend may take the material form of a continuous or discontinuous reaction member on the downstream side of the elements 11; the said reaction member may be a longitudinal bar 18 (FIG. 6) fixed to each water level raising element 11 or a nosing 19 (FIG. 7) fixed to the concrete or masonry of the sill 6 in the region of the downstream edge of the slot 12. The upstream and/or downstream faces of the water level raising elements 11 may also be provided with a continuous or discontinuous groove or other strength-reducing feature to ensure bending of the water level raising element 11 about line 17 under a predetermined load.

Figure 4A:
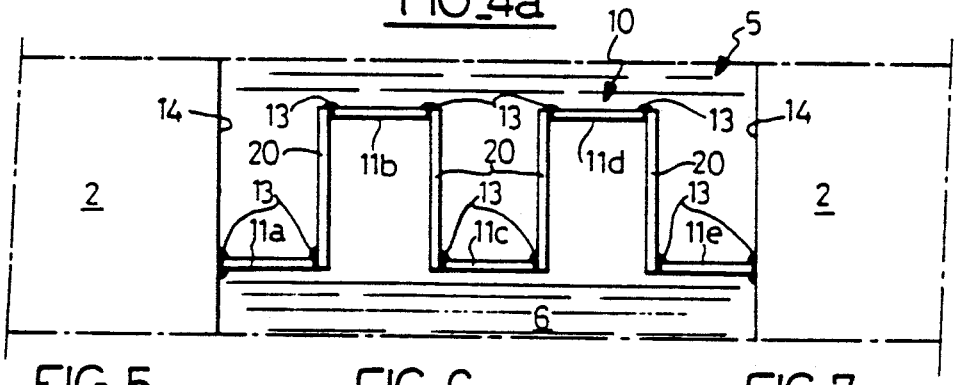
FIG. 4*a* is a view similar to that in FIG. 4 showing another possible arrangement of the water level raising elements.

In FIG. 4, all the elements 11 of the water level raising means 10 lie in the same vertical plane. Alternatively, they can be arranged in a staggered pattern as shown in FIG. 4*a*. In this case, other permanent water level raising elements 20 not designed to bend, also in the form of plates, are fixed rigidly to the sill 6 between the elements 11 in order to restore the continuity of the water level raising means 10, the permanent elements 20 being arranged parallel to each other and substantially in line with the direction of flow of water over the spillway. Under these circumstances, the crest line of the water level raising means 10 is no longer rectilinear but crenellated so that the length of the crest over which water can spill is substantially increased which, as will be described below, enables the head on the water level raising means (i.e. the thickness of the overflowing nappe) to be reduced for a given headwater level and discharge rate, which in turn enables the height of the water level raising means to be increased, thereby further augmenting the storage capacity of the reservoir.

Figure 8A:
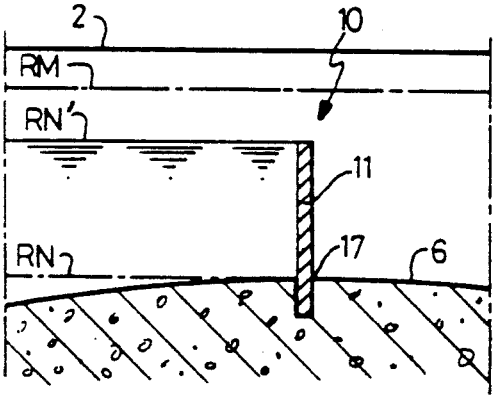
FIGS. 8*a* to 8*e* are vertical sections illustrating the manner in which the water level raising means of the invention functions before, during and after discharging a flood.
Figure 8B:
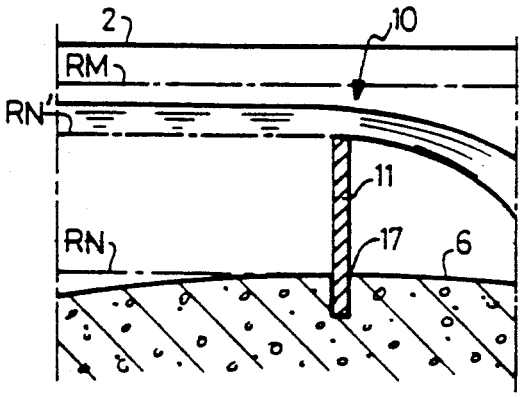

As illustrated in FIG. 8*a*, the water level raising means 10 of the invention raises the full supply level in the reservoir from level RN, which is the elevation of the spillway sill crest in the absence of water level raising means 10, to a level RN, corresponding to the height of the water level raising means 10 above the sill 6. As will be explained below, each water level raising element 11 is designed to have sufficient bending strength to resist water loads not in excess of the head applied by a predetermined water level N which is not higher than the maximum water level RM aforementioned. If for example the said predetermined level N is equal to RM then, so long as the water level remains below RM during floods of small to moderate size and between RN, and RM, the excess water spills over the water level raising means 10 as shown in FIG. 8*b* without the water level raising means being destroyed. After the flood has receded, the headwater level falls back to RN' or a lower level if water is otherwise drawn from the reservoir.

Figure 8C:
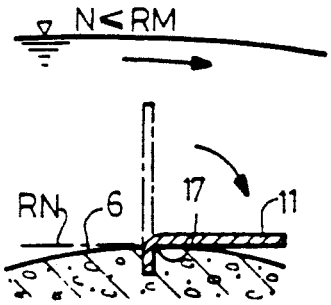
Figure 8D:
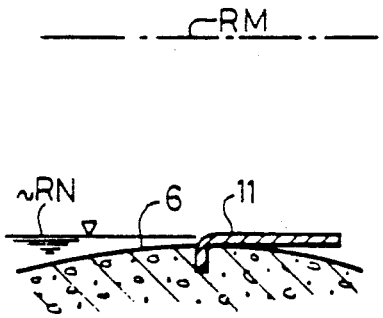
Figure 8E:
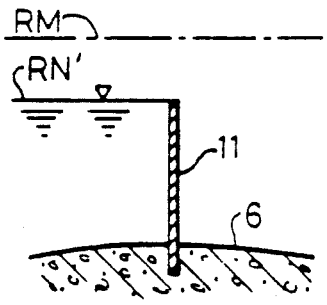

However if under the circumstances described the headwater level reaches a predetermined level N equal to or slightly lower than RM in the event of the arrival of a major or extraordinary flood, at least one of the elements 11 forming the water level raising means 10 bends under the water pressure about line 17 as shown in FIG. 8*c*, thereby enabling the largest floods to discharge. After recession of a major flood which has bent the water level raising means 10, conditions at the overspill sill 6 are as shown in FIG. 8*d*, where the headwater level has returned to RN or lower. It is possible to carry a small number of spare elements 11 always available on site to make good the water level raising means 10 as necessary and so restore the higher full supply level RN' as shown in FIG. 8*e*. It is stressed that failure to replace any element(s) after a major flood has bent at least one element 11 in no way affects the operational safety of the structure.

Risks of jamming or other type of failure of the system to operate by reason of floating debris can easily be overcome by using conventional techniques of upstream protection adapted to suit the individual case. Such protection may for example consist of floating booms across the reservoir some distance upstream of the spillway or barriers on the upstream face of the dam.

There now follows a quantified example of the design of a water level raising means of the invention. In normal practice, the dimensions of dams and overflow spillways are set such that the level of the headwater (reservoir level) reaches the maximum water level RM during the passage of a predetermined flood called the design flood. This may for example be the flood occurring only one year in a thousand years (1000-year flood).

Let it be assumed that the river flow during the design flood is for example 200 $m^3/s$ and that the uncontrolled overflow sill 6 is 40 m long. Then, the height H of the head of water on the sill 6 (the depth or thickness of the overflowing nappe) needed to discharge the design flood flow must be such as to discharge 5 $m^3/s$ per linear meter of sill. This height H can be calculated with the equation:

$$Q=1.8\ H^{3/2} \quad (1)$$

from which it can be seen that H is approximately equal to 2 m under the abovementioned assumptions. Again, on these assumptions, if there is no system of gates or other means of preventing flow over the sill, the elevation of the sill 6 of spillway 5 must be set 2 m lower than the maximum water level RM in order to discharge the 1000-year flood and the volume of water corresponding to this height of 2 m is lost for productive use.

In designing the proper height of the water level raising elements 11, the invention is based on the fact that the maximum river discharge observed on average over a 20-year period is much less than the design flood flow. In the illustrative example given here, it might be about 50 $m^3/s$. From equation 1 this flow can be discharged with a head on the sill of approximately 0.8 m. If it is accepted that the water level raising elements 11 might be destroyed on average once every twenty years, said elements can be made 1.2 m high (2 m−0.80 m=1.2 m) to permit the 50 $m^3/s$ discharge to overflow over the elements 11 with a depth of water on the top of the water level raising means of 0.8 m. Under these circumstances, the full supply level RN′ is raised 1.20 m higher than the full supply level RN for the uncontrolled overflow spillway sill 6 in the absence of the water level raising means. If the water level raising elements are made more than 1.2 m high, the depth of the overflowing water will be less than 0.8 m and it would have to be accepted that the said elements might be destroyed for example every ten years but the full supply level on the other hand would be raised even higher. Conversely, if the water level raising elements are made less than 1.2 m high, the depth of overflowing water would be more than 0.8 m and the said elements would then only be destroyed once in every 50 or 100 years but the full supply level would then be lower than in the previous cases. The choice of water level raising element height is thus chiefly based on economics. It is probably preferable to set a twenty year interval between any two successive total destructions of the water level raising means which would mean a theoretical height of 1.2 m for the water level raising elements in the example considered.

There are advantages if not all the water level raising elements 11 are bent for the same headwater level. For example, a single element such as element 11*c* in FIGS. 3 and 4 can be arranged to bend when the water reaches a first level N1 approximately 10 cm lower than maximum water level RM, at least one other element 11, such as elements 11*b* and 11*d* can be arranged to bend when the water reaches a second level N2 approximately 5 cm lower than maximum water level RM, and the other elements 11, such as 11*a* and 11*e*, can be arranged to bend when the water reaches the said maximum water level RM.

In this manner, the destruction of the first element 11*c* by a flood of moderate size might be sufficient to discharge the flood without any further rise in headwater level, which would prevent destruction of elements 11*a*, 11*b*, 11*d* and 11*e*. However, the 10 cm margin thus allowed adds to the depth of the nappe overflowing the water level raising means so that the height of the elements and thereby of the extra water stored (RN′−RN) becomes 1.1 m (2 m−0.8m−0.1 m) in the example considered.

The bending of water level raising element(s) 11 and their ensuing destruction is governed by (i) the driving moment Mm, being the moment of the forces tending to bend the relevant element and (ii) the resisting moment Mr, being the moment of the forces tending to resist the element bending at line 17. If no triggering device directly controlled by water level is provided to trigger the bending of the element at precisely the predetermined water level, the water level at which the opposing forces are balanced can only be determined to within some degree of uncertainty which may be as much as 0.2 m. Under these circumstances, it may be necessary for safety reasons to reduce the height of the element(s) 11 by an amount commensurate with this margin of uncertainty, say by 0.2 m for example. Nevertheless it is possible to dispense with this need to reduce the height of the elements by providing a triggering device which will be described below with reference to FIG. 11.

For the 50 $m^3/s$ flow considered in this example, it is possible to reduce the 0.8 m depth of overflowing water, being the maximum head on the water level raising means before the element(s) bend, by changing the crest of the elements 11 considered in combination from parallel to the crest of the spillway sill 6 to a non-rectilinear shape, e.g. a crenellated line as shown in FIG. 4*a*, in order to increase the length available for the abovementioned flow to discharge. If the length is doubled in this way, the 50 $m^3/s$ flow will be spread over a length of 80 m instead of 40 m and the maximum head on the sill of the water level raising means is reduced from 0.8 m to 0.5 m. If all other conditions remain unchanged, this enables the water level raising elements 11 to be made 3 m higher and thereby increase the volume of water stored in the reservoir accordingly.

Figure 9A:
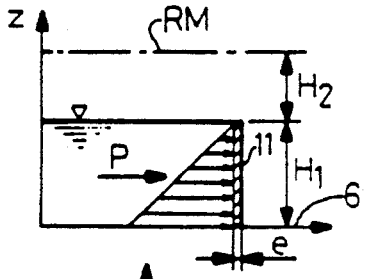
FIGS. 9*a* and 9*b* are graphical representations of the forces acting on a water level raising element of the invention in service.
Figure 9B:
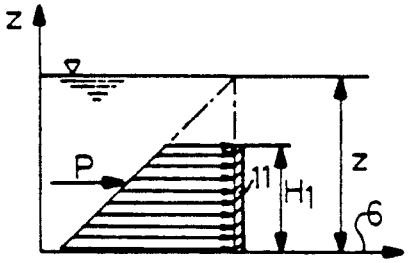

FIGS. 9*a* and 9*b* show the forces which may be applied to a water level raising element 11 of the invention in service. In the description which follows, it is assumed that the element 11 is a plate of thickness e and height $H_1$ above the sill 6. In FIGS. 9*a* and 9*b*, RM designates as before the maximum reservoir level, $H_2$ designates the maximum head on crest of element 11 (the maximum depth of overflowing water before the element bends) and z designates the water level above the sill 6. The driving forces tending to bend the element 11 are the pressure P of the water acting on the upstream face of the element 11. The resisting forces which resist bending of the element 11 are the inherent strength of the element 11.

In order to simplify the calculations in the present example, it is assumed that the reaction line 17 about which the water level raising element 11 bends is flush with the sill 6. Under these circumstances, in order to calculate the value of P and the corresponding driving moment Mm with respect to line 17, one must consider two cases according to the height of water z above the sill 6. The values of P and Mm and the value of the resisting moment Mr are summarised below, the said values being given per unit length of the water level raising element 11.

a) If $0 < z < H_1$ $$P = \frac{1}{2} \cdot \gamma_w \cdot z^2 \quad (2)$$

-continued $$Mm = \frac{1}{6} \cdot \gamma_w \cdot z^3 \quad (3)$$

b) If $H_1 < z$ $$P = \frac{1}{2} \cdot \gamma_w \cdot H_1^2 + \gamma_w \cdot H_1 \cdot (z - H_1) \quad (4)$$

$$Mm = \frac{1}{6} \cdot \gamma_w \cdot H_1^3 + \frac{1}{2} \cdot \gamma_w \cdot H_1^2 \cdot (z - H_1) \quad (5)$$

In both cases $$Mr = (\tfrac{1}{3})/\sigma_a \cdot e^2 \quad (6)$$

In the above equations, P, Mm, Mr, e, $H_1$ and z have the meanings already designated hereinabove. $\gamma_w$ is the unit weight of water and $\sigma_a$ is the yield point of the material from which the water level raising element is made, e.g. steel.

Figure 10:
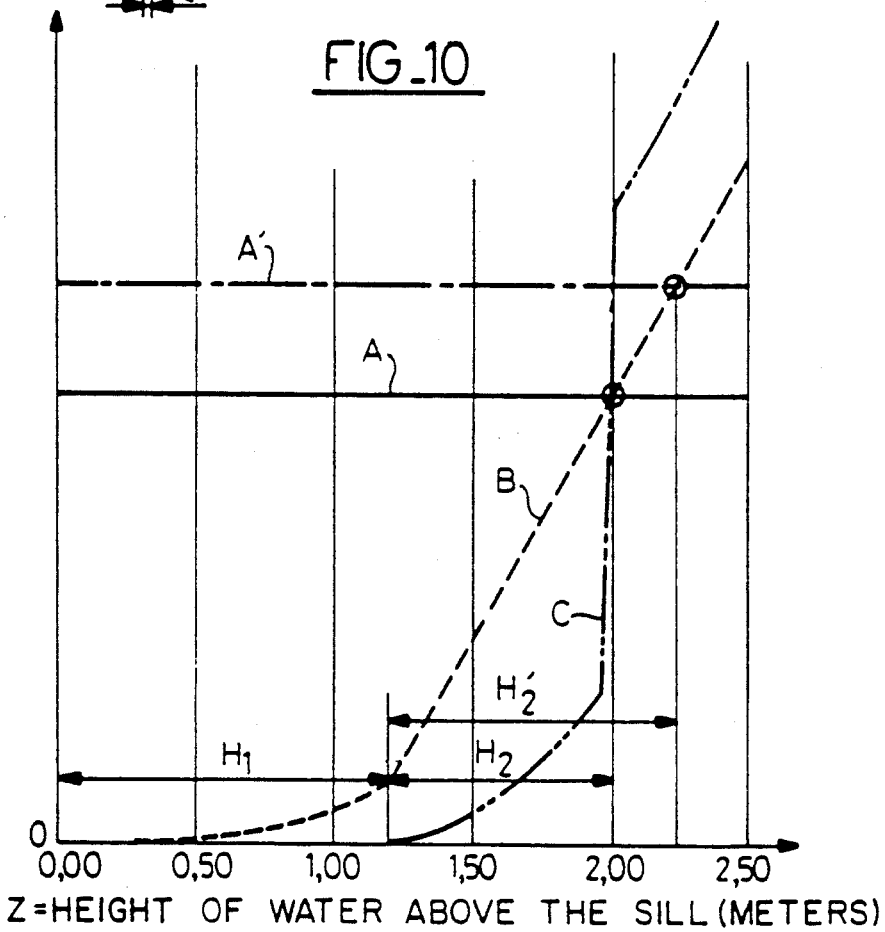
FIG. 10 is a chart showing the driving and resisting forces versus the head of water on the overspill sill and spillway discharge versus the thickness of the overspilling nappe.

In the graph in FIG. 10, curves A and B represent the values of Mr and Mm respectively as a function of the height of water z above the sill 6, and curve C represents the values of spillway discharge Q as a function of the head on the sill (the thickness of the overflowing nappe) ($Q=1.8\ H^{3/2}$ with $H=z-H_1$ before bending of the water level raising element 11, and $H=z$ after bending of the said element). Curves A, B and C are drawn from the above equations and for $H_1=1.2$ m, $e=2$ cm, $\gamma_w=1$ and $\sigma_a=30$ kg/mm$^2$.

From curves A and B, it can be seen that the driving moment Mm reaches the same value as the resisting moment Mr for a value of z ($H_1+H_2$) of approximately 2 m, i.e. for the maximum level RM in the numerical example considered. In other words, the water level raising element bends when the headwater level reaches the maximum level RM. From the graph in FIG. 10 and equations 5 and 6, it can be seen that, with the same height $H_1$ of the water level raising element 11, the said element can be made to bend at a value of z smaller or greater than 2 m by reducing or increasing respectively the value of e and/or the value of $\sigma_a$ with respect to the values of these parameters considered above.

From this, it can be seen that, by selecting appropriate values for the height $H_1$ and thickness e of the water level raising means and an appropriate constituent material therefor (yield point $\sigma_a$) the element 11 can be designed to bend for a predetermined headwater level.

Figures 11, 12A, 12B, 12C, 13A, 13B, 13C:
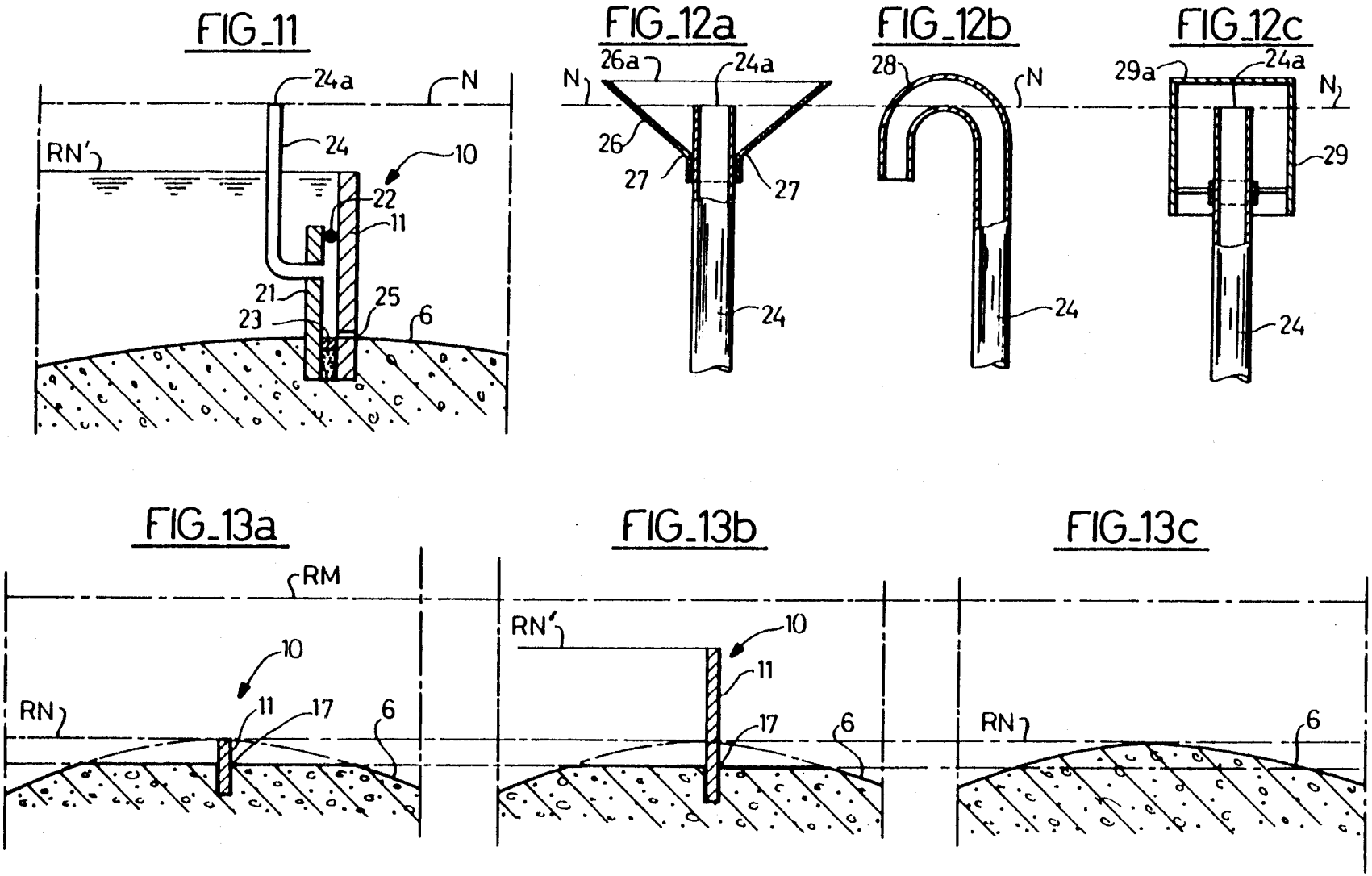
FIG. 11 is a cross section showing a water level raising element of the invention incorporating a triggering device to initiate bending of the element.
FIGS. 12*a* to 12*c* are larger scale views of various protective devices which can be provided at the upper portion of the triggering device shown in FIG. 11.
FIGS. 13*a* to 13*c* are cross sections comparing maximum nappe heights in the case of the present invention for water level raising elements of different heights (FIGS. 13*a* and 13*b*) and for a known uncontrolled overspill (FIG. 13*c*).

In the graph in FIG. 10, the curve A' plots the values of the resisting moment Mr' as a function of z for the case in which the water level raising element 11 consists of a pair of plates 11 and 21 of different heights with a seal 22 to close off the intervening space as shown in FIG. 11. The two plates 11 and 21 may be set in the same slot 12 in which case a continuous or discontinuous spacer 23 may be provided at the bottom between the two plates or they may be inserted into separate slots.

From curves A' and B, it can be seen that the driving moment Mm reaches the same value as the resisting moment Mr' for a value of z ($H_1+H'_2$) of approximately 2.25 m. It can also be seen that if the full water pressure were applied to the lower part of the downstream plate 11 when z reaches a value between $H_1+H_2$ and $H_1+H'_2$, there would be a sudden change in equilibrium conditions at this value of z. Naturally, in this case, if it is desired that bending still occurs for a value of z of 2 m or less, the thickness e and/or yield point $\sigma_a$ of plate 11 would have to be selected such that its resisting moment Mr (curve A in FIG. 10) is lower than indicated in the figure. This can be put to effective use to cause element 11 to bend even more reliably and precisely with respect to the predetermined water level. It can be arranged for water to enter the space between the two plates 11 and 21 in FIG. 11 when the headwater reaches a predetermined level N, the thickness and/or yield point of the plates being so selected that at this time, the resisting moment suddenly changes from a value Mr' that is higher than the value of the driving moment Mm to a value Mr that is substantially lower than the value of the said driving moment Mm.

For this purpose, it is possible to provide a triggering device such as for example that shown in FIG. 11. The triggering device consists basically of a vent pipe 24 which under normal conditions keeps the space between plates 11 and 21 at atmospheric pressure, the top end 24a of the vent pipe 24 being at a level N which is the water level at which it is desired for the element 11 to bend. The pipe 21 may be bent and pass through the plate as shown in FIG. 11. A hole 25 of smaller size than the bore of vent pipe 24 is provided near the bottom of the downstream plate 11 near the sill 6 to drain away any water entering the space between plates 11 and 21 due to leakage past the seal 22 or ingress through the top opening of the pipe 24 due to waves before the headwater has truly reached level N.

If more than one water level raising element 11, 21 are provided and designed to bend at different water levels such as N1, N2 and RM (FIG. 3) at least one vent pipe 24 is provided for each element and each pipe 24 rises upwards to a level N equal to level N1 or N2 or RM at which the relevant element is to bend.

The top end of each vent pipe 24 may be fitted with a protective device against floating debris to prevent them from becoming blocked by such debris or a protective device against waves to prevent one or more successive waves from triggering the bending of the plate 11 at the wrong time. Protective devices are illustrated in FIGS. 12a to 12c. The protective device shown in FIG. 12a consists basically of a funnel 26 whose top rim 26a is higher than the level N and which has at least one small hole 27 at a lower level than level N. In FIG. 12b, the protective device consists of the vent pipe 24 itself whose top length is bent to a siphon shape 28. Lastly, the protective device in FIG. 12c consists of a hood or bell 29 over the top end 24a of the vent pipe 24 and whose top surface 29a is slightly higher than level N.

It may be beneficial for improving safety at an existing dam whose overspill sill 6 had originally been set at a level appropriate for the originally-estimated design flood and determines the full supply level RN (FIG. 13c), to lower the sill 6 by a few decimeters below its original level (setting the original level RN)) and to set into the lowered sill 6 a water level raising means 10 of the invention, consisting of at least one element 11 whose height and thickness have been selected in the manner described hereinabove to bend about line 17 when the headwater level reaches a predetermined level not higher than the maximum water level RM corresponding to the design flood. Under these circumstances, the probability of breaching of the water level raising means 10 remains unchanged but in the event of arrival of an extraordinary flood, the free discharge section available after complete destruction of the water level raising means 10 is substantially increased with the same headwater level in the reservoir, enabling a much larger flood than the flood for which the dam was originally designed to be discharged without risk. If the height of the water level raising elements 11 is equal to the amount by which the sill 6 is lowered (FIG. 13*a*), the result is simply an increase in the safety of the structure with the same full supply level RN as before the sill 6 was lowered (FIG. 13*c*). However, it is possible both to increase the safety of the structure and raise the full supply level to a higher level RN' by making the water level raising elements of a height such that their crests lie at a higher level than RN but below RM (FIG. 13*b*).

Figure 14A:
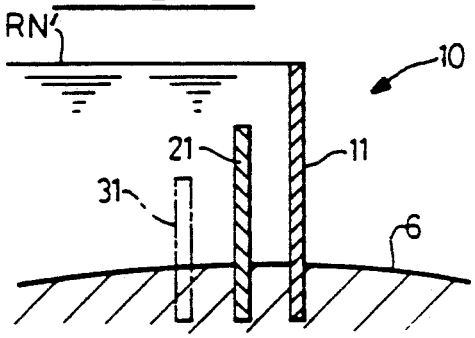
FIGS. 14*a* to 14*d* are vertical cross sections illustrating the manner in which a double water level raising means functions in another embodiment of the invention.
Figure 14B:
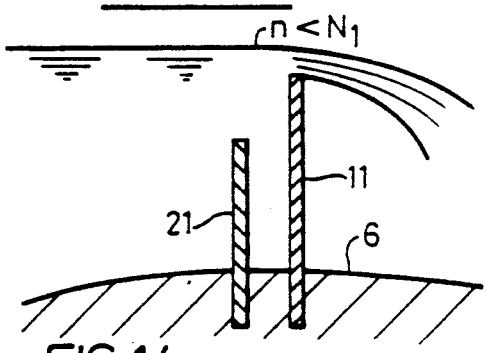
Figure 14C:
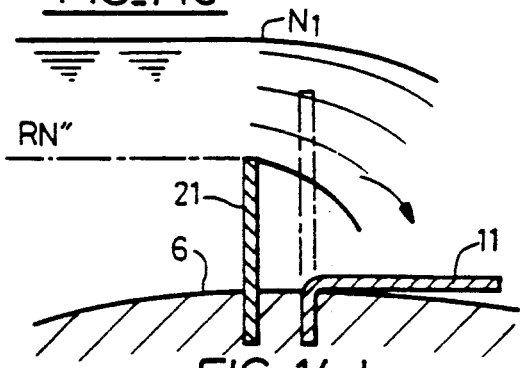
Figure 14D:
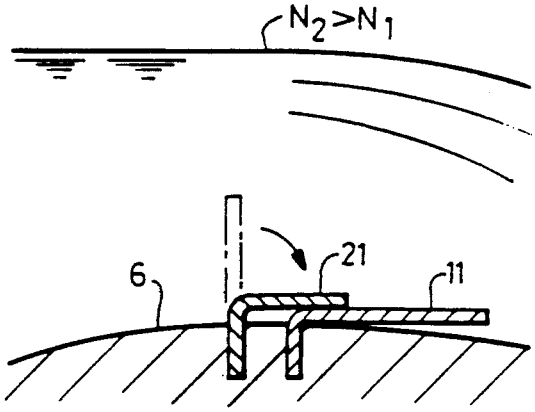

In the embodiment shown in FIG. 11 it is assumed that the two plates 11 and 21 are inserted in the same slot 12 and joined together. However, the two plates 11 and 21 or an even greater number of plates, for example three plates 11, 21 and 31 (FIG. 14*a*) can be set in one or more slots in the sill 6, these plates having different heights in increasing order from upstream to downstream with thicknesses and yield points so selected as to bend successively, commencing with the downstream one and ending with the upstream one, under hydrological conditions of increasing severity as illustrated in FIGS. 14*a* to 14*d* in the case of two plates 11 and 21. In this way, if the bending of the downstream plate 11 is sufficient to discharge a flood of moderate size which has caused the headwater level to rise to a first predetermined level N1 (RN'<N1<RM), plate 21 remains upright (FIG. 14*c*) and the full supply level is only partially lowered (RN" instead of RN' before bending of plate 11). If the bending of plate 11 is not enough to discharge the flood and the headwater level reaches a second predetermined level N2 (N1<N2M), plate 21 bends subsequently as shown in FIG. 14*d*. After bending of plate 11 and if applicable plate 21 and recession of the flood, the plate(s) 11 and 21 can be replaced by new plates.

Figure 15:
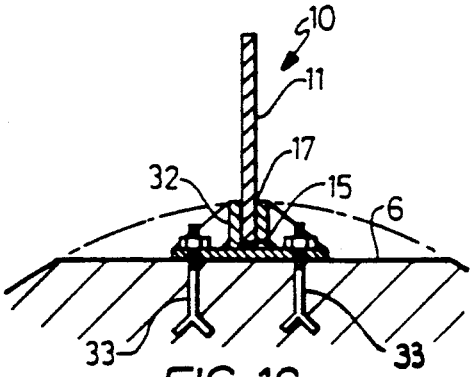
FIGS. 15 to 17 are vertical cross sections showing other embodiments of the water level raising wall element of the invention.

In the embodiments previously described, each plate 11 (or 21 or 31) forming an element of the water level raising means is let into a slot provided in the sill 6. Nevertheless, the plate 11 (or 21 or 31) may be set into a slot formed in a continuous or discontinuous mount 32 itself rigidly fixed to the sill 6, e.g. by means of nut and anchor bolt assemblies 33 cemented into the sill 6 as shown in FIG. 15. The sill 6 is preferably lowered by at least an amount corresponding to the height of the mount 32.

Figure 16:
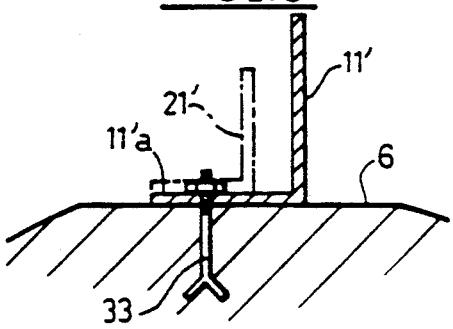

In another embodiment, instead of letting the plate 11 (or 21 or 31) into a slot, it can be affixed as shown in FIG. 16. In this example, plate 11', seen in vertical cross section, is bent to an L shape and its horizontal arm 11'*a* is rigidly fixed to the sill 6 by a means preventing all relative movements between the said plate and the sill 6, for example by anchor bolts (and nuts) 33 (only one being shown in FIG. 16) cemented into the sill 6. Where more than one plate is provided, such as the pair of plates 11' and 21' in FIG. 16, they may be fixed together on sill 6 by the same anchor bolts (and nuts) 33. Alternatively, instead of using L-shaped plates, it is possible to use straight vertical plates such as plates 11 in FIGS. 8, 13, 14 and 15 which are fixed rigidly to the sill 6 by steel angles, the vertical legs of the angles being fixed to the plate by e.g. welding and their horizontal legs fixed to the sill 6 in a manner like to what is shown in FIG. 16. In the latter case, it is the thickness and yield point of the material forming the angles that are considered in calculating the resisting moment Mr determining the headwater level at which the water level raising elements bend.

Figure 17:
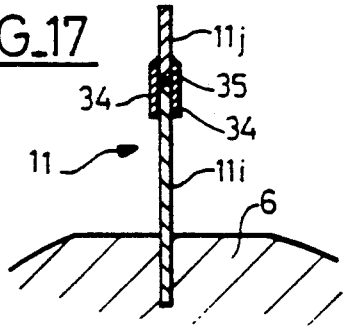
Figure 18:
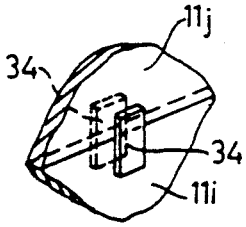
FIG. 18 is a perspective view showing a detail of the water level raising element in FIG. 17.

FIG. 17 is a vertical cross section through a water level raising element consisting of two plates 11*i* and 11*j*, plate 11*j* being set in a non-permanent fashion on top of plate 11*i*. More than one plate 11*j* can be stacked in this way if so desired. Plates 11*i* and 11*j* can be held together by at least two pairs of fishplates 34, of which only one pair is visible in FIGS. 17 and 18, which are fixed rigidly to one of the plates and provide a slot for accommodating the other plate. Instead of the fishplates 34, it is possible to use strips running the whole length of the plates 11*i* and 11*j*. A seal 35 is provided between plates 11*i* and 11*j* and between the further plates 11*j* if applicable. These plates may all have the same vertical dimension or different vertical dimensions; for example, the vertical dimension of the top plate 11*j* is shown smaller than the vertical dimension of the bottom plate 11*i*. This type of construction for the water level raising element not only makes it easier to install the water level raising elements in place, but it is also possible to vary water level raising element height according to the season of the year without needing any particular human supervision with respect to flood discharge.

In conclusion, the height of the water level raising means 10 and thereby of its elements 11 is a decision based on economics, the desired progression in the bending of the different water level raising elements, the accuracy and precision of the bending with respect to the predetermined water level (accuracy and precision can be improved by providing a triggering device as described hereinbefore with reference to FIG. 11) and the shape of the water level raising means crest line which may be rectilinear or crenellated. In the numerical example described, the height of the water level raising elements so calculated may range from 0.9 m to 1.5 m by which between 45% and 75% (depending on the final design) of the water which would otherwise, without the water level raising means, be wasted, can be saved.

From the foregoing, it is clear that the water level raising means of the invention provides a substantial and quasi-permanent augmentation of the storage capacity of a dam or other structure with uncontrolled overspill discharge works while at the same time maintaining or improving the safety which is inherent in uncontrolled overspills in that major and extraordinary floods are reliably discharged by the automatic opening (bending of at least one water level raising element) with no human supervision or action and no control mechanism or device. It is also clear that the water level raising means can be constructed and installed on the spillway sill of a dam or other structure at a much lower cost than the spillway gates hitherto used and without any major modification to the spillway sill.

It is expressly understood that the embodiments of the invention described hereinabove are given on a purely illustrative basis and in no way preclude other alternative forms and that numerous modifications can readily be elaborated by any person ordinarily skilled in the art without departing from the basic principles of the invention.

What is claimed is:

1. Overflow spillway for dams and similar structures comprising an overspill sill having a crest set at a first predetermined level, lower than a second predetermined level corresponding to a maximum reservoir level for which the dam is designed, the difference between the said first and second predetermined levels corresponding to a predetermined maximum discharge of a design flood, and a water level raising means on the sill of the spillway, wherein the water level raising means comprises at least one water level raising element in the form of a substantially vertical plate having a lower portion which is rigidly fixed to the sill of the spillway, the said element having a predetermined height which is less than the difference between the aforementioned first and second predetermined levels and which corresponds, for a headwater level substantially equal to the said maximum level to a mean flood with a predetermined lower discharge than the predetermined maximum discharge, the said element being of such thickness at its fixed lower portion and made of a material with such a yield point that the moment of the forces applied to the water level raising element by the water comes to equal the resisting moment at the fixed lower portion of the said element so that the said water level raising element bends about a line when the headwater reaches a third predetermined level higher than the top of the water level raising element but not higher than the second predetermined level.

2. Overflow spillway as claimed in claim 1, wherein the plate forming the water level raising element is let into a slot in the sill.

3. Overflow spillway as claimed in claim 1, wherein the plate forming the water level raising element is let into a slot in a mount affixed to the sill.

4. Overflow spillway as claimed in claim 1, wherein the plate forming the water level raising element is bent to an L shape with its horizontal leg rigidly fixed to the sill by fixing means preventing any relative movement between contact surfaces of the said plate and sill.

5. Overflow spillway as claimed in claims 1, wherein in the case of an existing spillway, the crest of the overspill sill is lowered to a lower level than the said first predetermined level and the water level raising element is rigidly fixed on the lowered sill and is given a height such that its top is at a level at least equal to the said first predetermined level but lower than the said second predetermined level.

6. Overflow spillway as claimed in claim 1, wherein a seal is provided between the overspill sill and the lower portion of the water level raising element.

7. Overflow spillway as claimed in claims 1, wherein the said water level raising element consists of a pair of plates of different heights with a seal between the two.

8. Overflow spillway as claimed in claim 7, wherein comprising at least one vent pipe which under normal service conditions maintains a space between the two plates at atmospheric pressure, the top end of the vent pipe being at a level equal to the said third predetermined level.

9. Overflow spillway as claimed in claim 1, wherein a plurality of water level raising elements are located side-by-side along the crest of the spillway sill with seals between adjacent edges of the said elements.

10. Overflow spillway as claimed in claim 9, wherein the thickness and yield point of the water level raising elements are such that at least a first one of said elements bends when the headwater reaches the said third predetermined level, the said third level being lower than the said second predetermined level, that at least a second one of said elements bends when the headwater reaches a fourth predetermined level between the second and third predetermined levels, and that at least a third one of said elements bends when the headwater reaches a fifth predetermined level higher than the fourth level but not higher than the second predetermined level.

11. Overflow spillway as claimed in claim 1, wherein the water level raising means comprises at least two elements located one after the other in the upstream-downstream direction and being of different heights in increasing order in the upstream-downstream direction, the thicknesses and yield points being so selected that the downstream element bends when the headwater reaches the said third predetermined level lower than the second predetermined level and that the upstream element bends when the headwater reaches a fourth predetermined level higher than the third predetermined level but not higher than the second predetermined level.

12. Overflow spillway as claimed in claim 1, wherein said element comprises at least two stacked vertical plates.

13. Overflow spillway as claimed in claim 1, wherein the water level raising means comprises a plurality of vertical plates in a staggered pattern between permanent vertical plates such that the crest line of the water level raising means has a crenellated shape when seen in plan view.

* * * * *